US005509399A

United States Patent [19]

Poor

[11] Patent Number: 5,509,399

[45] Date of Patent: Apr. 23, 1996

[54] SEMI-AUTOMATIC FLUID POWERED GUN

[76] Inventor: Keith A. Poor, 5302 Whispering Meadows La., Rogers, Ark. 72758

[21] Appl. No.: 371,759

[22] Filed: Jan. 12, 1995

[51] Int. Cl.[6] ..... F41B 11/26; F41B 11/06

[52] U.S. Cl. ..... 124/76; 124/74

[58] Field of Search ..... 124/56, 66, 67, 124/71, 72, 73, 74, 76

[56] References Cited

U.S. PATENT DOCUMENTS

| | | | |
|---|---|---|---|
| 645,932 | 3/1900 | Beck et al. . | |
| 2,147,003 | 2/1939 | Von Kozurik | 124/72 |
| 2,357,951 | 9/1944 | Hale | 124/72 |
| 2,817,328 | 12/1957 | Gale . | |
| 2,818,056 | 12/1957 | Martin | 124/72 |
| 2,881,752 | 4/1959 | Blahnik | 124/74 X |
| 2,940,438 | 6/1960 | Merz | 124/74 X |
| 3,103,212 | 9/1963 | Merz | 124/74 X |
| 3,177,863 | 4/1965 | Spack | 124/74 X |
| 3,547,095 | 12/1970 | Vadas et al. | 124/74 X |
| 3,612,026 | 10/1971 | Vadas et al. | 124/74 X |
| 3,824,981 | 7/1974 | Crane et al. | 124/74 X |
| 3,996,916 | 12/1976 | Koehn et al. | 124/72 |
| 4,073,280 | 2/1978 | Koehn | 124/72 |
| 4,083,349 | 4/1978 | Clifford | 124/72 |
| 4,116,193 | 9/1978 | Chiba | 124/72 |
| 4,531,503 | 7/1985 | Shepherd | 124/76 |
| 4,602,608 | 7/1986 | Lacam et al. | 124/74 |
| 4,616,622 | 10/1986 | Milliman | 124/73 |
| 4,936,282 | 6/1990 | Dobbins et al. | 124/74 |
| 5,054,464 | 10/1991 | Young | 124/72 |
| 5,063,905 | 11/1991 | Farrell | 124/72 |
| 5,257,614 | 11/1993 | Sullivan | 124/73 |
| 5,280,778 | 1/1994 | Kotsiopoulos | 124/73 |
| 5,285,766 | 2/1994 | Milliman | 124/72 |
| 5,349,938 | 9/1994 | Farrell | 124/73 |
| 5,349,939 | 9/1994 | Perrone | 124/76 |
| 5,383,442 | 1/1995 | Tippmann | 124/76 |

*Primary Examiner*—Eric K. Nicholson
*Assistant Examiner*—John A. Ricci
*Attorney, Agent, or Firm*—Hovey, Williams, Timmons & Collins

[57] ABSTRACT

A semi-automatic fluid powered gun includes an elongated barrel having opposed front and rear open ends, and a projectile storage clip for storing a plurality of projectiles outside of the barrel and for sequentially positioning each projectile in line with the barrel adjacent the rear end. A transfer tube is supported to the rear of and in line with the barrel and is movable between a forward position in which it moves the positioned projectile into the barrel and prevents the other stored projectiles from being positioned in line with the barrel, and a rear position in which the transfer tube permits the next stored projectile to be positioned in line with the barrel. An elongated cylinder is positioned to the rear of and in line with the barrel and includes opposed front and rear open ends, and the transfer tube is received in the front end of the cylinder to provide fluid communication between the cylinder and the barrel when the transfer tube is in the forward position. A piston is received in the rear end of the cylinder and is movable within the cylinder relative to the transfer tube between forward and rear positions. The piston faces the transfer tube to define a chamber within the cylinder that is connected to a source of pressurized fluid by a passage. A valve is provided in the fluid passage for controlling the flow of fluid from the source to the chamber, and a hammer opens the valve to deliver pressurized fluid to the chamber so that the fluid acts forward through the transfer tube to fire the projectile from the front end of the barrel and rearward against the piston to move the piston to the rear position. A slide is interposed between the piston and the hammer for moving the hammer to the cocked position when the piston is in the rear position, and a trigger releases the hammer from the cocked position to initiate firing of the hammer.

12 Claims, 4 Drawing Sheets

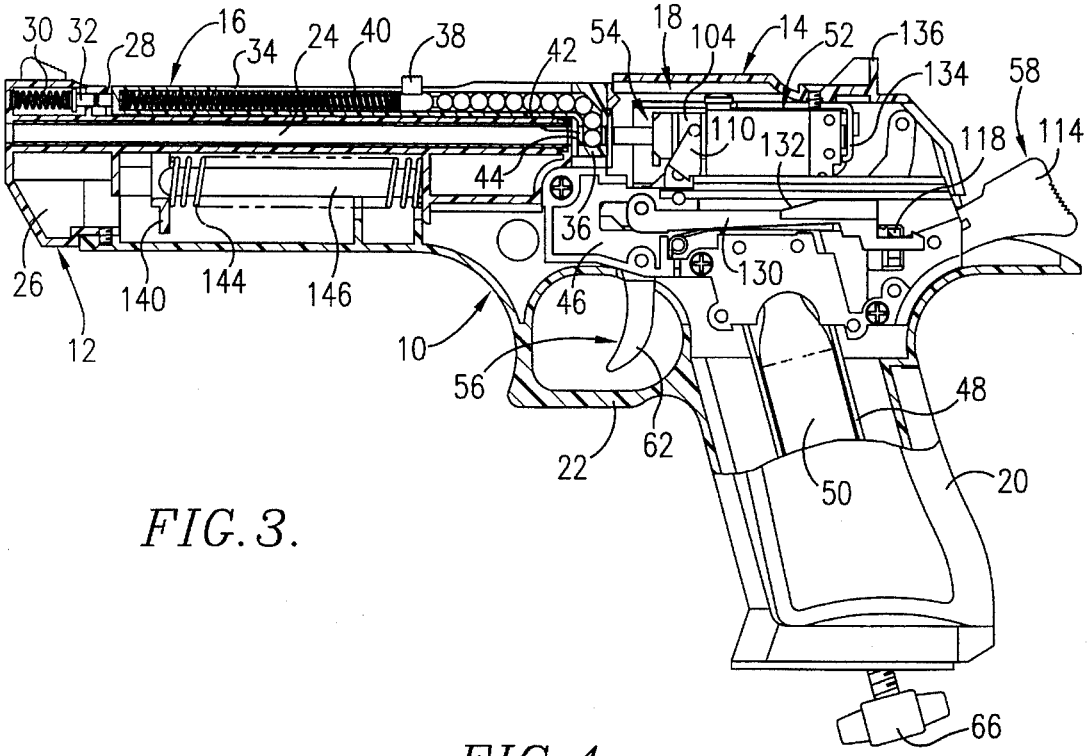
FIG. 3.
FIG. 4.
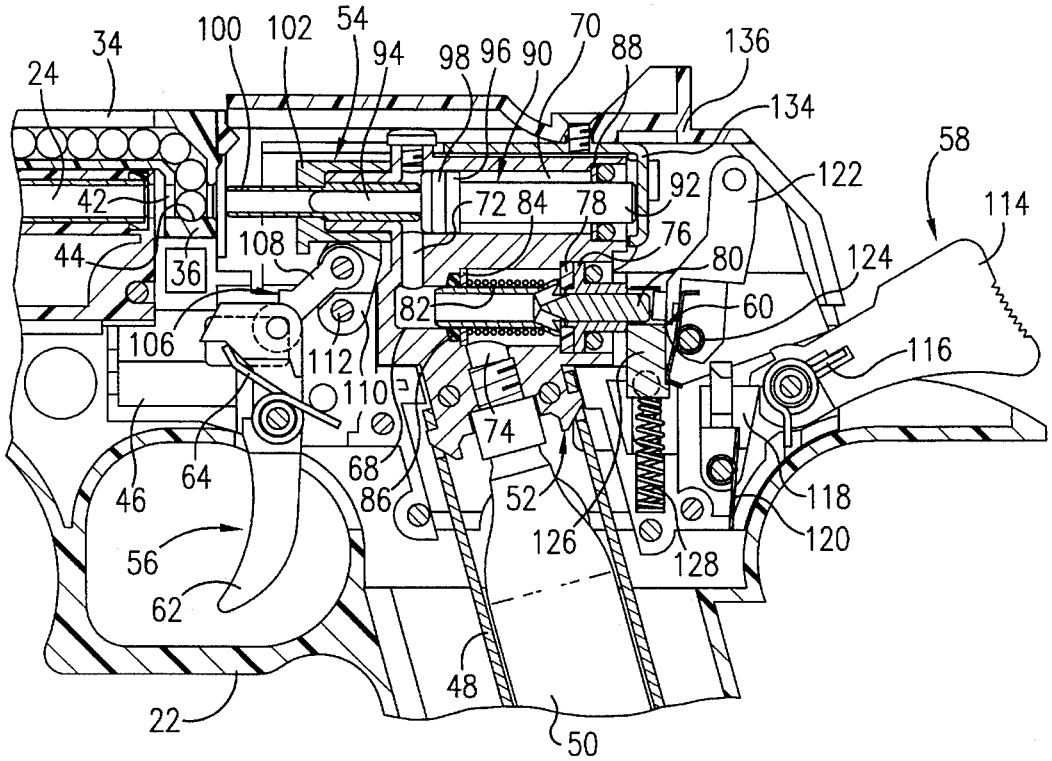

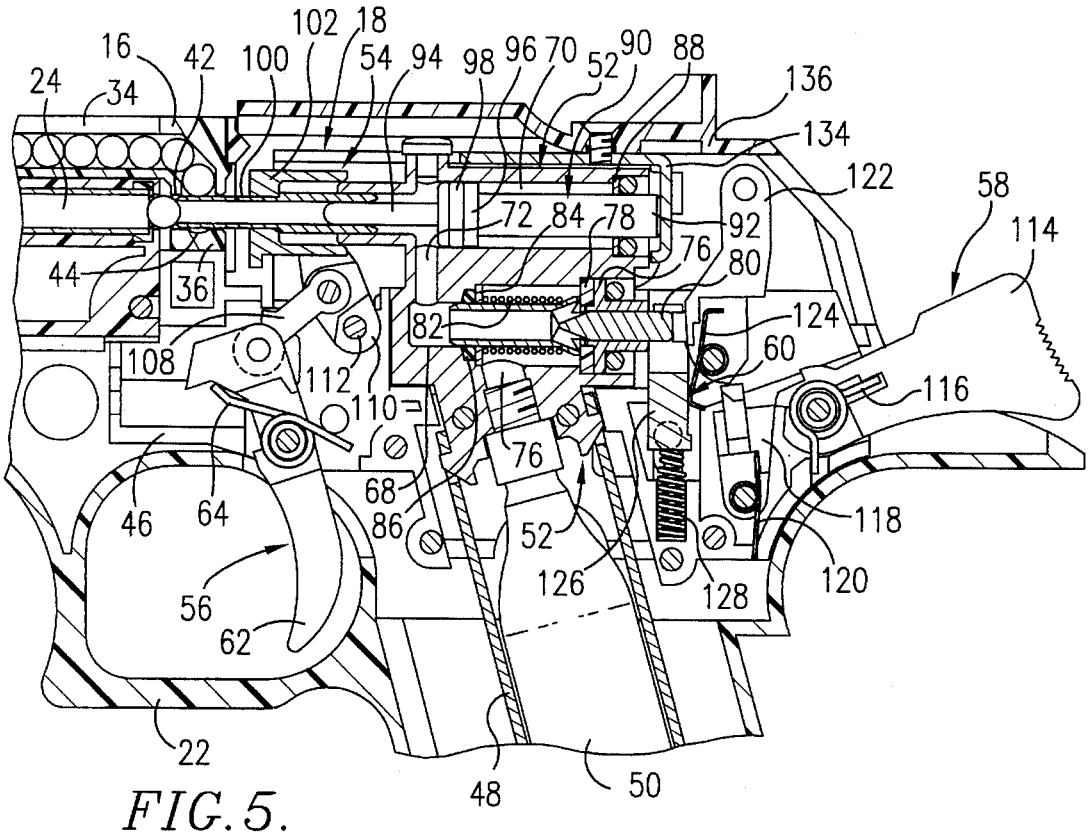
FIG. 5.
FIG. 6.
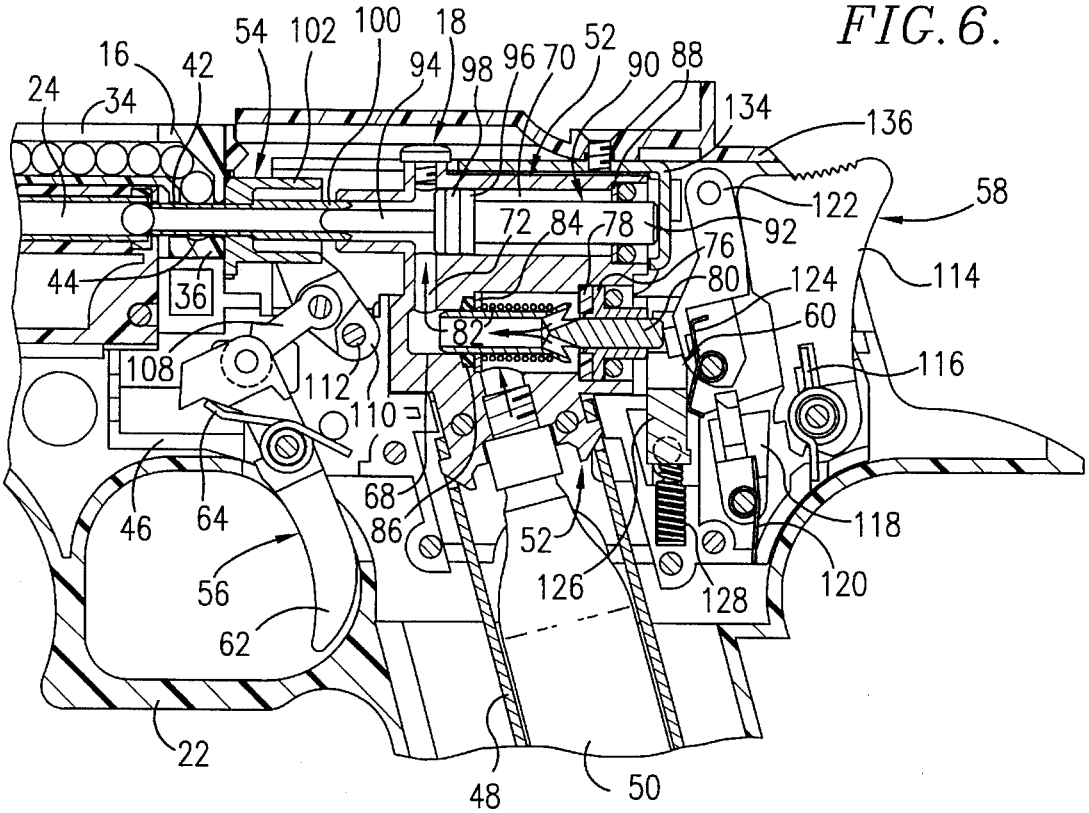

SEMI-AUTOMATIC FLUID POWERED GUN

BACKGROUND OF THE INVENTION

1. Field of the Invention

The present invention relates generally to fluid powered guns and, more particularly, to a semi-automatic fluid powered gun in which a single charge of compressed fluid is used to blow back a slide assembly, fire a projectile, and recock the gun for subsequent firing.

2. Discussion of the Prior Art

Semi-automatic $CO_2$ guns are known in the art for use in shooting pellets or other projectiles. An example of one such gun is shown in U.S. Pat. No. 2,817,328, issued to Gale on 24 Dec. 1957. The Gale patent illustrates the use of a gun in which pressurized $CO_2$ is used to both fire the BB and cock the gun for a subsequent firing.

The gun disclosed in the Gale patent includes a frame presenting a main body, and an upper tubular part having a small-diameter forward region and a large-diameter rear bore. A barrel assembly is received in the upper tubular part, and includes a hollow barrel received in the forward region, and a piston and a rear extension received in the rear bore. A reciprocating hammer is supported within the body of the gun and is movable between forward and rear positions.

In the forward position, the hammer opens a valve, releasing $CO_2$ into the upper tubular part forward of the piston so that the gas pressure forces the barrel assembly rearward. As this movement of the assembly occurs, the barrel is retracted, exposing a port through which pressurized gas enters the barrel and propels the BB from the gun. At the same time, the rearward piston movement causes the arm to retract the hammer, closing the valve. The hammer is retained in the cocked position by a latch that is released upon subsequent operation of a trigger of the gun.

The barrel of the gun illustrated in the Gale patent includes an opening forward of the port through which gas enters the barrel. This opening moves into alignment with a projectile storage clip in the forward position of the barrel assembly, and permits a single projectile to be loaded into the barrel. A small spring is positioned forward of the hole for preventing the projectile from falling out of the gun before it is fired, and a transverse pin extends through the barrel to prevent the projectile from rolling rearward into the bore of the upper tubular part of the frame.

Several shortcomings exist in conventional semi-automatic fluid powered guns which effect their efficiency and accuracy. For example, in guns of the type illustrated in the Gale patent, the entire barrel assembly reciprocates with each firing. Because of the weight of the assembly, more gas pressure is required to move the assembly than would be the case with a stationary barrel. Further, any holes, springs or other protuberances extending into the barrel create turbulence in the gas flow during firing, adversely effecting the accuracy of the gun. Such turbulence also reduces the power of the gun, thus discounting efficiency.

Another problem encountered in the use of conventional semi-automatic fluid powered guns resides in the concealment of the hammer within the frame such that it is difficult to verify the position of the hammer when cocked. It would be desirable to provide a gun that closely resembles an actual firearm, including a working slide and hammer that are positioned realistically.

OBJECTS AND SUMMARY OF THE INVENTION

It is an object of the present invention to provide a semi-automatic fluid powered gun that overcomes the shortcomings inherent with conventional designs, improving the efficiency and accuracy of the gun. Efficiency is improved by presenting a stationary barrel that is free of any unnecessary holes or protrusions, and by reducing the total volume of the chamber and any passages that must be pressurized during each firing of the gun. At the same time, these features also improve the accuracy of the gun.

It is another object of the invention to provide a construction that closely resembles an actual "Desert Eagle™" firearm, including a movable slide that cocks a rear-mounted hammer automatically each time the gun is fired.

In accordance with these and other objects evident from the following description of a preferred embodiment of the invention, a semi-automatic fluid powered gun includes an elongated barrel having opposed front and rear open ends, and a projectile storage means for storing a plurality of projectiles outside of the barrel and for sequentially positioning each projectile in line with the barrel adjacent the rear end. A transfer tube is supported to the rear of and in line with the barrel and is movable between a forward position in which the transfer tube moves the positioned projectile into the barrel and prevents the other stored projectiles from being positioned in line with the barrel, and a rear position in which the transfer tube permits the next stored projectile to be positioned in line with the barrel. An elongated cylinder is positioned to the rear of and in line with the barrel and includes opposed front and rear open ends. The transfer tube is received in the front end of the cylinder and provides fluid communication between the cylinder and the barrel when the transfer tube is in the forward position. A piston is received in the rear end of the cylinder and is movable within the cylinder relative to the transfer tube between forward and rear positions. The piston faces the transfer tube to define a chamber within the cylinder.

The gun also includes a source of pressurized fluid, and a fluid passage extending between the source of pressurized fluid and the chamber. A valve is provided in the fluid passage for controlling the flow of fluid from the source to the chamber, and a hammer is provided for opening the valve to deliver pressurized fluid to the chamber so that the fluid acts forward through the transfer tube to fire the projectile from the front end of the barrel and rearward against the piston to move the piston to the rear position. The hammer is movable between a cocked position out of engagement with the valve and a fired position in which the hammer opens the valve. A hammer operating means is interposed between the piston and the hammer for moving the hammer to the cocked position when the piston is in the rear position, and a trigger means releases the hammer from the cocked position to initiate firing of the hammer.

By providing a construction in accordance with the present invention, numerous advantages are obtained. For example, by providing a stationary barrel and an independent transfer tube separate from both the barrel and the piston of the gun, less force is required to fire and cock the gun than is used in conventional constructions. Thus, the gun can be fired more times with a given amount of pressurized gas than the known guns. In addition, the size of the chamber formed between the transfer tube assembly and the piston is minimized to reduce the volume of gas needed to operate the gun. This also improves the efficiency.

Another advantage obtained by employing the present invention resides in the ability of the gun to reload projectiles into the barrel without requiring the use of holes in the barrel or protuberances for retaining the projectiles in place. Instead, the present invention permits the use of a barrel that is free of such roughness, presenting a smooth barrel surface to the pressurized gas propelling the projectile from the gun.

BRIEF DESCRIPTION OF THE DRAWING FIGURES

The preferred embodiment of the invention is described in detail below with reference to the attached drawing figures, where:

FIG. 3 is a sectional side view of the gun, illustrating the gun in a cocked, ready to fire position;

FIG. 4 is a fragmentary sectional side view of the gun in the ready to fire position;

FIG. 5 is a fragmentary sectional view similar to FIG. 4, illustrating the trigger pulled to a position in which a sear of the gun is about to release the hammer for firing;

FIG. 6 is a fragmentary sectional view similar to FIG. 4, illustrating the gun during an initial stage of firing;

DETAILED DESCRIPTION OF A PREFERRED EMBODIMENT

Figure 1:
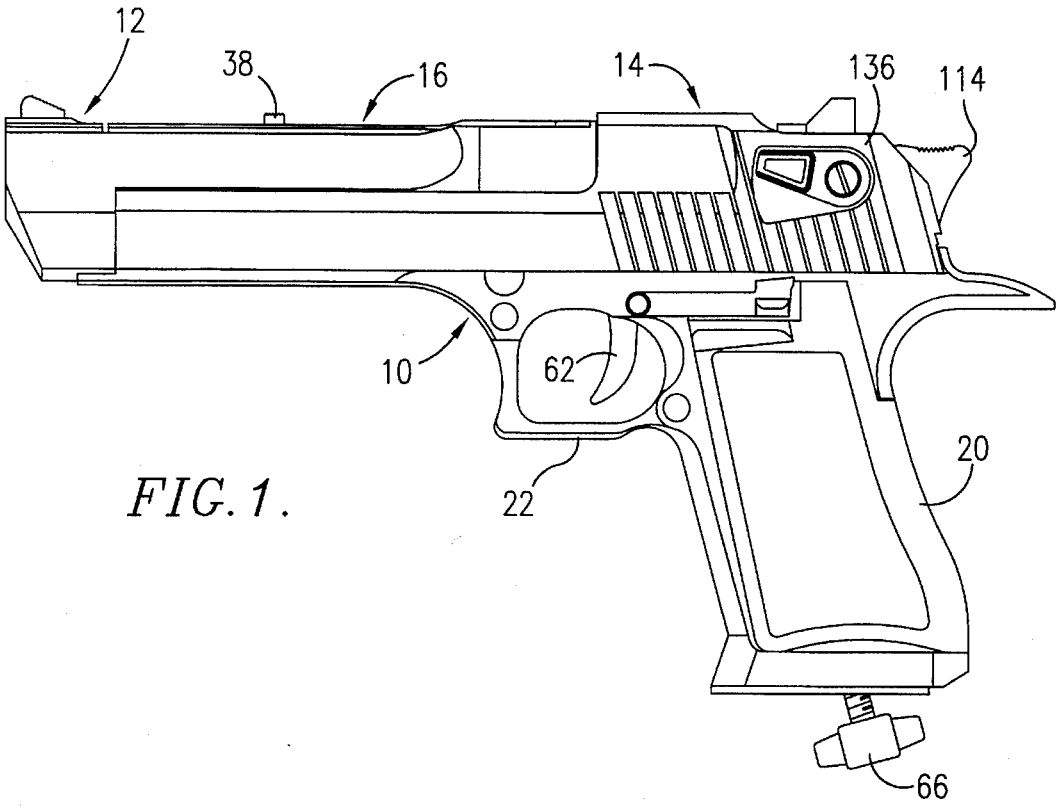
FIG. 1 is a side elevational view of a gun constructed in accordance with the preferred embodiment.
Figure 2:
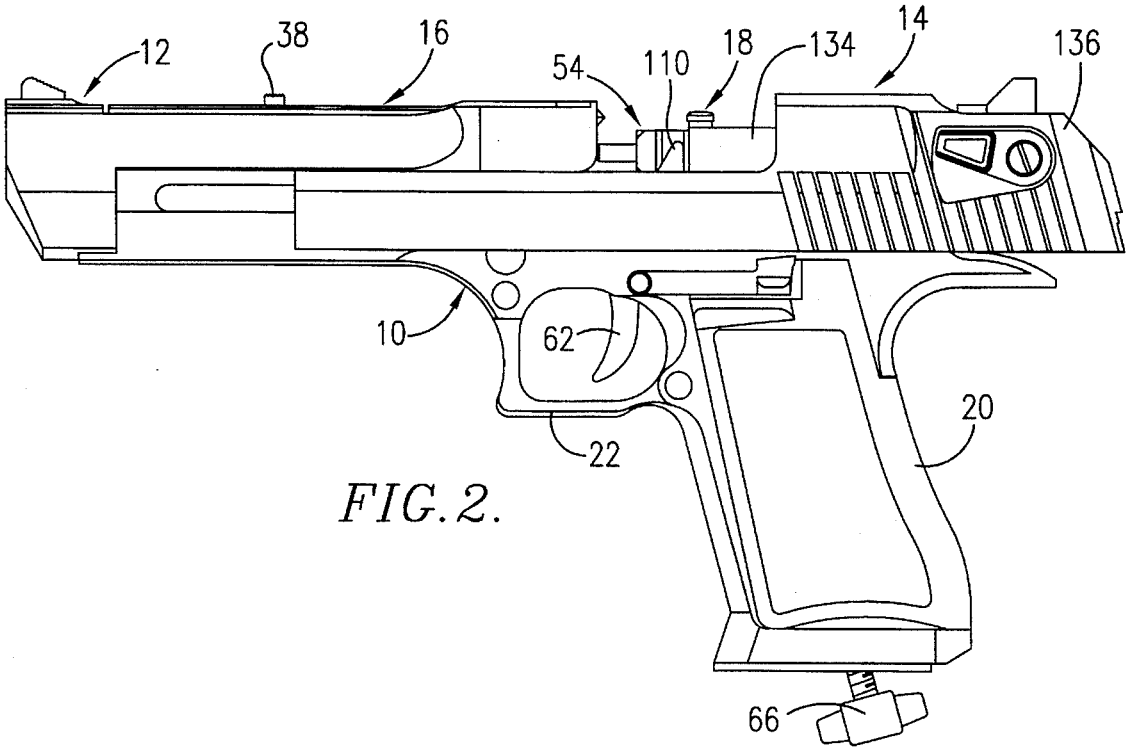
FIG. 2 is a side elevational view of the gun, illustrating a slide of the gun in a rear position during cocking.

A semi-automatic fluid powered gun constructed in accordance with the preferred embodiment is illustrated in FIG. 1, and broadly includes a frame assembly 10, a barrel assembly 12, a slide assembly 14, and a clip 16 for storing a plurality of projectiles. Turning to FIG. 2, the gun is illustrated with the slide assembly in a rear position, exposing a mechanism assembly 18 of the gun.

The frame assembly 10 includes a unitary body presenting an open, hollow handle 20, a trigger guard 22, and a barrel support adapted to receive the barrel during assembly. Preferably, the frame is formed of a synthetic resin, but other materials may be used.

The barrel assembly 12 is shown in FIG. 3, and is fastened to the frame body. The barrel assembly includes a body that is preferably molded of a synthetic resin, a metal barrel 24, a weight 26 for balancing the gun, and an upper recess 28 for receiving the clip 16. A small cavity 30 is formed in the body forward of the clip, and a spring biased button 32 extends between the cavity and the recess 28 for holding the clip in place on the barrel assembly.

The metal barrel 24 is preferably formed of brass, and includes an uninterrupted inner surface between open front and rear ends. The body of the barrel assembly and the recess for the clip extend beyond the rear end of the barrel a short distance, and permit the clip 16 to extend beyond the barrel, as described below.

The clip is formed of the same material as the frame, and includes an interior cavity adapted to store projectiles, such as BBs, pellets, paint balls or the like. A slot 34 extends along the top of the clip, and is of a width less than the diameter of the projectiles so that the projectiles are retained in the clip. An inlet is formed at the front of the slot for permitting projectiles to be loaded into the clip, and an outlet housing 36 depends from the rear end of the clip. A tab 38 is received in the cavity for sliding movement, and a spring 40 biases the tab toward the outlet so that the projectiles are always biased toward the outlet housing. As shown in FIG. 4, an opening 42 extends horizontally through the outlet housing, and a floor 44 extends beneath the opening for positioning the projectile within the housing and holding it in place. When the clip is properly positioned in the barrel cavity, the outlet housing is positioned directly behind the barrel, and the opening in the housing is generally aligned with the barrel. However, the floor of the housing is slightly below the barrel so that the projectile positioned in the housing is not free to roll into the barrel and from the gun. The pressure exerted on the positioned projectile by the remaining stored projectiles holds the positioned projectile in place, and also prevents it from rolling from the housing. A magnet or other means may be provided for assisting in holding each projectile in place in the outlet housing prior to being loaded into the barrel.

The mechanism assembly 18 is shown in FIG. 4, and broadly includes a pair of laterally opposed side plates 46 and a frame 48 for supporting a $CO_2$ cylinder 50 or other source of pressurized fluid. Further, the side plates support a valve assembly 52, a transfer tube assembly 54, a trigger assembly 56, a hammer assembly 58, and an interrupter assembly 60.

The side plates are formed of metal, and function to support and position the parts of the mechanism assembly within the frame 10 relative to the barrel. The trigger assembly 56 includes a trigger 62 supported between the side plates for pivotal movement between a forward, home position, and a rear, pulled position. A torsion spring 64 is provided for biasing the trigger toward the forward position.

The cylinder frame 48 includes a U-shaped strip of metal that extends from the side plates into the handle of the frame, and supports the $CO_2$ cylinder 50 within the gun. A puncture screw 66 is provided in the bottom of the cylinder frame and extends out from the frame handle so that once a cylinder is inserted into the cylinder frame, the cylinder can be forced up into a seated position against the valve assembly 52, puncturing the cylinder and delivering pressurized $CO_2$ to the valve assembly.

The valve assembly 52 includes lower and upper cylinders 68, 70 that are connected together by a passage 72, and the lower cylinder is connected to the $CO_2$ cylinder by an inlet passage 74. The lower cylinder is divided into four longitudinal regions that are progressively stepped from a large-diameter rear region to a small-diameter front region. The rear region presents an open rear end of the lower cylinder, and receives a cap 76 that is held in the cylinder by a pair of transverse pins. A seal 78 is provided in front of the cap for preventing gas from escaping from the rear end of the cylinder.

The region forward of the rear region presents a valve inlet chamber and opens into the inlet passage 74 to the $CO_2$ cylinder. A valve stem 80 is received in the inlet chamber and includes a rear end that protrudes through the cap 76 out the rear end of the cylinder, a hollow tapered flange presenting a rear edge that seats against the seal in the closed position of the valve to prevent gas from the inlet chamber from exiting the chamber, and a tubular forward end protruding from the flange out the front end of the cylinder. The forward end opens into the flange so that when the flange is unseated from the seal, pressurized gas within the inlet chamber and the $CO_2$ cylinder is discharged through the flange and the forward end of the stem into the passage 72.

A spring 82 is provided in the inlet chamber for biasing the stem against the seal, and a spring seat 84 presents a surface against which the spring rests. An O-ring seal 86 is received in the region behind the front region for preventing gas from leaking from the front of the cylinder, and seals against the forward end of the valve stem. The front region of the lower cylinder is of a length sufficient to accommodate reciprocating movement of the valve stem during opening and closing of the valve.

The upper cylinder 70 of the valve assembly 52 includes three stepped regions. The rear, large-diameter region presents an open rear end that is adapted to receive an end cap 88 normally held in place by a pair of transverse pins extending through the body. A piston 90 is received in the upper cylinder and includes a rear portion 92 extending through the end cap 88 and from the rear end of the cylinder, a front portion 94 having a diameter smaller than the rear portion, and a piston head 96 connected between the front and rear portions. The piston head is sized for receipt in the intermediate stepped region of the upper cylinder, and seats against the front region of the cylinder in a forward position of the piston. An O-ring 98 is provided on the piston head for preventing gas from leaking past the piston head out the rear end of the cylinder when the gun is fired.

The small-diameter front region of the upper cylinder includes an inner diameter that is larger than the diameter of the front portion 94 of the piston, and presents an outer diameter smaller than the rest of the upper cylinder 70. The passage 72 between the cylinders communicates with the upper cylinder at the front end of the intermediate region so that when gas is delivered to the upper cylinder, it is introduced between the piston head 96 and the front stepped region of the cylinder.

The transfer tube assembly 54 includes an elongated tube 100 having a constant inner diameter and a stepped outer diameter. A block 102 is fitted on the tube against the step from the front and is secured to the tube so that the assembly moves as a unitary piece. The block presents an opening adjacent the rear end of the tube sized for receipt of the front end of the cylinder and the outer diameter of the tube 100 at the rear end is only slightly smaller than the inner diameter of the front region of the cylinder 70 so that the cylinder is sandwiched between the rear end of the transfer tube and the block when the transfer tube assembly 54 is in a rear position, such as is shown in FIG. 4. The inner diameter of the transfer tube 100 is only slightly larger than the diameter of the front portion of the piston 90 so that the front piston portion is received in the tube in the forward position of the piston, and substantially closes off the tube to prevent pressurized gas from being discharged through the barrel before the desired time.

As shown in FIG. 3, the side surfaces of the block 102 each include a vertical slot 104 adapted to receive a transfer tube actuating assembly 106 that forms a part of the mechanism assembly. The actuating assembly is connected between the trigger 62 and the transfer tube assembly 54, and includes an intermediate link 108 connected for pivotal movement to the trigger, and a pair of side-by-side actuating links 110 that are connected to the intermediate link for pivotal movement. The actuating links are supported between the side plates 46 by a pin 112 that permits the links to pivot so that when the trigger is pulled, the intermediate link is drawn forward, pivoting the actuating links about the pin. The upper end of each actuating link includes an inward directed protuberance that engages the slot 104 on one side of the block so that the block is reciprocated relative to the cylinder and piston when the trigger is moved. The trigger spring 64 normally biases the transfer tube assembly toward the rear position, as shown in FIG. 4.

The hammer assembly 58 includes a hammer 114 that is supported between the side plates for pivotal movement between a cocked position, shown in FIG. 4, and a fired position, shown in FIG. 6. A spring 116 is provided for biasing the hammer toward the fired position. A sear 118 is also supported between the side plates for pivotal movement, and includes an upper pawl that engages a corner of the hammer when the hammer is cocked and the pawl is rotated against the hammer. A spring 120 is provided for biasing the sear against the hammer so that the sear automatically locks the hammer in the cocked position each time the hammer is moved to that position.

A transfer bar 122 is positioned forward of the hammer, and may be pivoted about a pin that supports the bar between the side plates. A spring 124 biases the transfer bar away from the hammer 114 and toward a position in contact with the rear end of the valve stem 80 so that when the hammer is released from the cocked position, the hammer spring 116 forces the hammer against the transfer bar, and pushes the bar against the valve stem, opening the valve.

The interrupter assembly 60 includes an interrupter 126 is provided forward of the transfer bar, and is supported between the side plates for sliding movement between an upper position interposed between the bar and the valve stem, as shown in FIG. 4, and a lower position removed from between the bar and valve stem, as shown in FIG. 6. A spring 128 biases the interrupter toward the upper position to prevent the gun from being fired when the trigger is not pulled. A link (not shown) is connected between the trigger and the interrupter on the right side of the gun for moving the interrupter to the lower position when the trigger is pulled. Preferably, the link includes an angled slot that engages a lateral pin of the interrupter to pull the interrupter down as the trigger is pulled. The link and pin are provided on the right side of the gun and are not shown in the figures. However, they are of a conventional construction.

An actuating linkage 130 is shown in FIG. 3, and is provided for pulling the sear away from the hammer 114 to release the hammer from the cocked position. The linkage 130 is connected for pivotal movement to the trigger 62 and extends rearward along the left side plate. The linkage includes a rear end presenting a ratchet or hook adapted to engage the sear and pull it away from the hammer as the trigger is pulled. The linkage also includes an upper edge presenting a ramp 132 to present a cam surface that permits the linkage to be shifted downward in a manner described below to release the sear 118 after the gun is fired. This feature of the gun also prevents the gun from being continuously fired without releasing the trigger after each shot.

Turning to FIG. 3, the slide assembly 14 includes a slide 134 formed of sheet metal or the like, and a slide cover 136 molded of the same material as the frame of the gun. The cover includes a top wall, a pair of depending side walls 138 that extend forward beyond the top wall and along the barrel assembly, and a front wall 140 connected between the side walls at the front end of the cover. The cover is designed to resemble the slide of an actual firearm, and covers the interior of the gun when in the position shown in FIG. 1, preventing dust and debris from entering the mechanism assembly.

Figure 8:
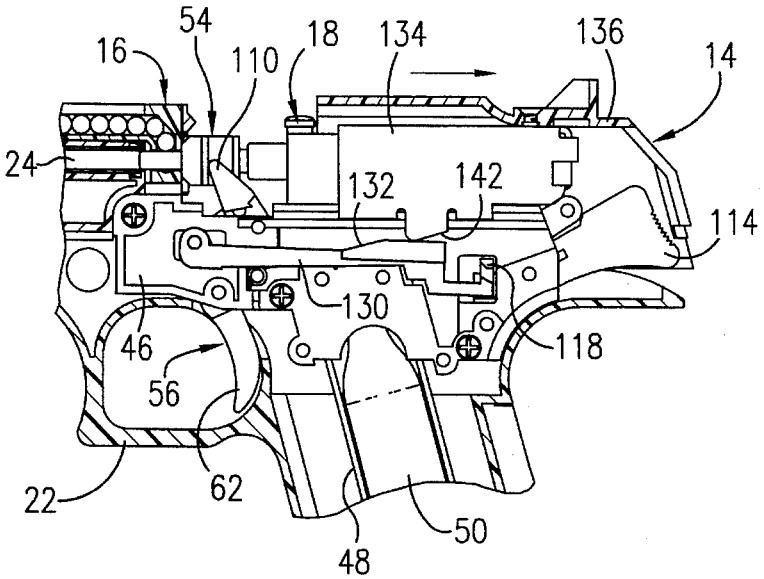
FIG. 8 is a fragmentary sectional view similar to FIG. 3, illustrating the gun in a fired position.

The slide 134 is shown in FIG. 8, and is box-shaped, including top, side and rear walls and presenting open front and bottom ends. The left side wall includes a depending cam 142 that is adapted to engage the ramp 132 of the linkage as the slide assembly moves rearward so that the linkage releases the sear. The slide cover 136 is connected to the top wall of the slide, and the two pieces move together as a unit. A spring 144, shown in FIG. 3, is supported between the front wall 140 of the slide cover and the body of the barrel assembly 12 for biasing the slide assembly forward toward the position shown in FIG. 1. Preferably, an elongated rod 146 is provided on the barrel assembly for supporting the spring 144, and the front wall of the slide includes a cutout through which the rod extends.

From the uncocked position shown in FIG. 1, the gun is cocked simply by pulling the slide assembly 14 rearward to the position shown in FIG. 2, wherein the hammer 114 is forced to the cocked position shown in FIG. 3. Alternately, the hammer may simply be pulled back to the cocked position.

Thereafter, as the trigger 62 is pulled, as shown in FIG. 5, it draws the intermediate link 108 of the transfer tube actuating assembly forward, causing the actuating links 110 to rotate counterclockwise about the pin. This movement of the links 110 translates the transfer tube 100 forward toward the barrel, and the tube forces the projectile within the outlet housing of the clip forward from the housing into the rear end of the barrel.

At the same time, the actuating linkage 130 is drawn forward, engaging the sear 118 and pulling the sear forward until the sear releases the hammer 114 from the cocked position. Although not shown, the trigger also pulls the linkage of the interrupter assembly 60 forward, camming the interrupter 126 downward against the spring 128 and out from between the transfer bar 122 and the rear end of the valve stem 80.

As shown in FIG. 6, once the hammer has been released by the sear, it moves forward under the force of the spring 116 and impacts the transfer bar 122, pushing the bar forward into engagement with the rear end of the valve stem. The valve stem moves forward under the force, lifting the flange forward from the seated position so that pressurized gas in the inlet chamber and the $CO_2$ cylinder flows past the flange into the front end of the valve stem and into the passage 72 leading to the upper cylinder 70. The gas enters the upper cylinder in front of the piston head 96, pushing the piston rearward. As the piston moves, the front portion 94 of the piston is drawn from the rear end of the transfer tube 100, allowing pressurized gas in the chamber to exhaust through the barrel, firing the projectile.

Figure 7:
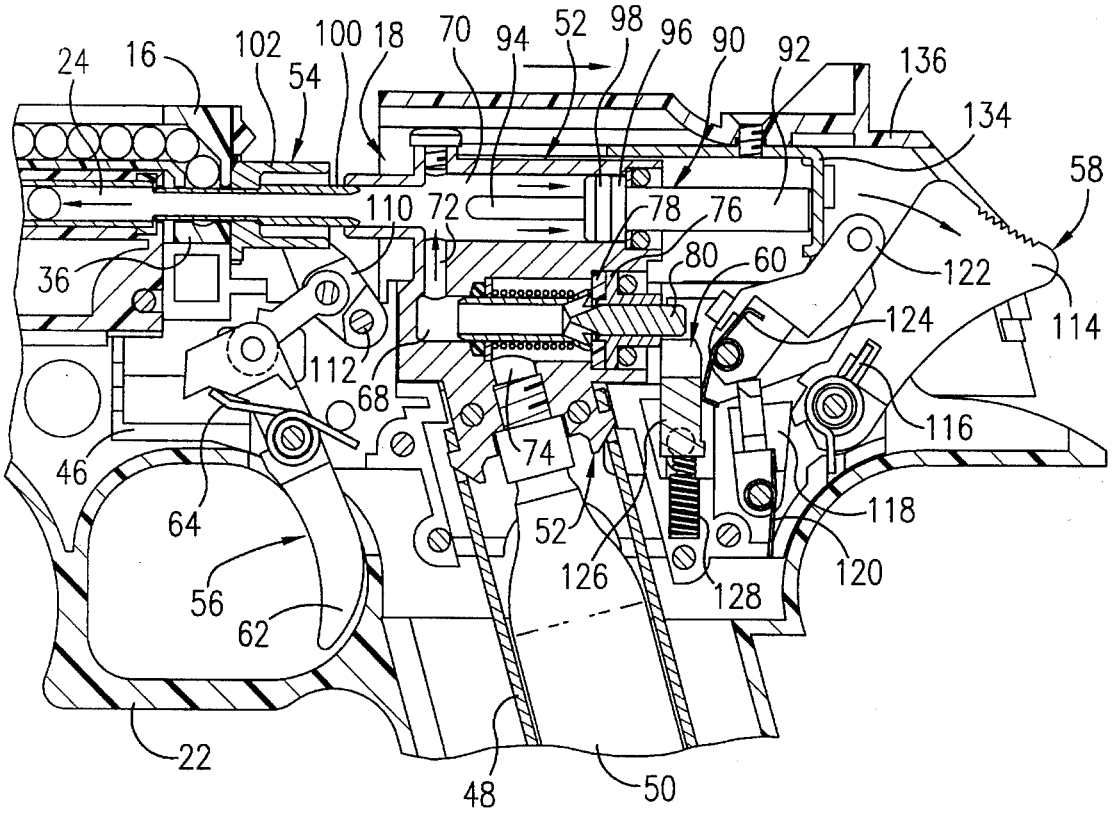
FIG. 7 is a fragmentary sectional view similar to FIG. 4, illustrating the gun during a subsequent stage of firing.

The slide is engaged by the rear portion 92 of the piston during rearward movement of the piston, and the two elements move rearward together to the position shown in FIG. 7, in which the slide assembly 14 engages the transfer bar 122, forcing it against the hammer to move the hammer to the cocked position. As the slide assembly moves rearward, the cam 142 on the side wall of the slide engages the ramp 132 of the linkage 130, forcing the linkage downward so that the sear 118 is released. The spring 120 returns the sear toward the hammer so that when the hammer is cocked, the sear catches the hammer and locks it in place. Thus, the gun is prevented from being automatically fired without first releasing the trigger and pulling it again. The spring biases the slide assembly and piston back toward the forward position as the gas is exhausted so that they are in position for a subsequent firing.

When the hammer 114 is cocked the force of the spring 116 is released from the transfer bar 122, allowing the valve spring 82 to return the stem 80 to the seated position to shut off gas flow to the upper cylinder. Thus, the gun is ready for a subsequent firing, and this is achieved by releasing the trigger and pulling it. As the trigger is released, the transfer tube 100 moves rearward under the force of the spring 64 acting through the actuating assembly 106, allowing the next projectile in the clip to move down into the outlet housing 36 in line with the barrel.

Although the present invention has been described with reference to the preferred embodiment illustrated in the attached drawing figures, it is noted that substitutions may be made and equivalents employed herein without departing from the scope of the invention as recited in the claims.

What is claimed is:

1. A semi-automatic fluid powered gun, comprising:

an elongated barrel having opposed front and rear open ends;

a projectile storage means for storing a plurality of projectiles outside of the barrel and for sequentially positioning each projectile generally in line with the barrel adjacent the rear end;

a transfer tube supported to the rear of and in line with the barrel and being movable between a forward position in which the transfer tube moves the positioned projectile into the barrel and prevents the other stored projectiles from being positioned in line with the barrel, and a rear position in which the transfer tube permits the next stored projectile to be positioned in line with the barrel;

a moving means for moving the transfer tube between the forward and rear positions to sequentially load projectiles into the barrel each time a projectile is fired;

an elongated cylinder positioned to the rear of and in line with the barrel and including opposed front and rear open ends, the transfer tube being received in the front end of the cylinder and providing fluid communication between the cylinder and the barrel when the transfer tube is in the forward position;

a piston received in the rear end of the cylinder and being movable within the cylinder relative to the transfer tube between forward and rear positions, the piston facing the transfer tube to define a chamber within the cylinder;

a source of pressurized fluid;

a fluid passage extending between the source of pressurized fluid and the chamber;

a valve provided in the fluid passage for controlling the flow of fluid from the source to the chamber, the valve being movable between open and closed positions;

a hammer for opening the valve to deliver pressurized fluid to the chamber, the fluid in the chamber acting forward through the transfer tube to fire the projectile from the front end of the barrel and rearward against the piston to move the piston to the rear position, the hammer being movable between a cocked position out of engagement with the valve and a fired position in which the hammer opens the valve;

a hammer operating means interposed between the piston and the hammer for moving the hammer to the cocked position when the piston is in the rear position; and a trigger means for releasing the hammer from the cocked position to initiate firing of the hammer.

2. A gun as recited in claim 1, wherein the barrel includes an uninterrupted surface between the front and rear ends.

3. A gun as recited in claim 1, wherein the piston includes a forward extension and the transfer tube includes a rear portion sized for receipt of the forward extension so that the transfer tube is substantially closed off by the forward extension when the piston is in the forward position.

4. A gun as recited in claim 3, wherein the transfer tube includes a block surrounding the tube and presenting an opening adjacent rear portion sized for receipt of the open front end of the cylinder so that the cylinder is sandwiched between the rear portion of the transfer tube and the block.

5. A gun as recited in claim 1, wherein the front end of the cylinder is stepped down to present a stop limiting forward movement of the piston.

6. A gun as recited in claim 1, wherein the source of pressurized fluid is a $CO_2$ cartridge that is removable from the gun.

7. A gun as recited in claim 1, further comprising a biasing means for biasing the valve toward the closed position.

8. A gun as recited in claim 1, further comprising a biasing means for biasing the hammer toward the fired position.

9. A gun as recited in claim 1, further comprising a biasing means for biasing the hammer operating means against the piston and for returning the piston to the forward position after the pressurized fluid in the chamber has been discharged from the barrel.

10. A gun as recited in claim 1, wherein the trigger means is movable between a forward home position and a rear pulled position, the gun further comprising a biasing means for biasing the trigger means toward the home position.

11. A gun as recited in claim 1, wherein the hammer operating means includes a movable slide member interposed between the piston and the hammer, the slide member being engaged by the piston and in engagement with the hammer so that the slide member moves the hammer to the cocked position when the piston is moved to the rear position.

12. A gun as recited in claim 1, further comprising a means for preventing the trigger means from releasing the hammer from the cocked position more than once each time the trigger means is actuated.

* * * * *